US008695852B2

(12) United States Patent
Bertin et al.

(10) Patent No.: US 8,695,852 B2
(45) Date of Patent: Apr. 15, 2014

(54) HEAD FOR DISPENSING FLUID MATERIAL

(75) Inventors: Romain Bertin, Evreux (FR); Sébastien Michaux, Caudebec les Elbeuf (FR)

(73) Assignee: Aptar France SAS, Le Neubourg (FR)

( * ) Notice: Subject to any disclaimer, the term of this patent is extended or adjusted under 35 U.S.C. 154(b) by 0 days.

(21) Appl. No.: 13/509,644

(22) PCT Filed: Dec. 7, 2010

(86) PCT No.: PCT/FR2010/052630

§ 371 (c)(1),
(2), (4) Date: May 14, 2012

(87) PCT Pub. No.: WO2011/070285

PCT Pub. Date: Jun. 16, 2011

(65) Prior Publication Data

US 2012/0292344 A1 Nov. 22, 2012

(30) Foreign Application Priority Data

Dec. 9, 2009 (FR) ..... 09 58813

(51) Int. Cl.
*B67B 1/00* (2006.01)

(52) U.S. Cl.
USPC ..... 222/153.13; 222/182; 222/402.11

(58) Field of Classification Search
USPC ..... 222/522, 519, 153.13, 321.7, 321.9, 222/384, 182, 402.11, 402.12, 402.13
See application file for complete search history.

(56) References Cited

U.S. PATENT DOCUMENTS

| | | | | |
|---|---|---|---|---|
| 6,601,735 | B2 * | 8/2003 | Milian et al. | 222/153.11 |
| 7,575,132 | B2 * | 8/2009 | Stuart et al. | 222/383.1 |
| 7,857,174 | B2 * | 12/2010 | Michaux et al. | 222/507 |
| 7,874,461 | B2 * | 1/2011 | Bae | 222/153.13 |
| 7,874,465 | B2 * | 1/2011 | Bertin et al. | 222/402.12 |
| D655,200 | S * | 3/2012 | Gross et al. | D9/687 |
| 8,308,029 | B2 * | 11/2012 | Ki | 222/309 |
| 8,490,837 | B2 * | 7/2013 | Michaux et al. | 222/153.13 |
| 2008/0023498 | A1 * | 1/2008 | Bertin et al. | 222/402.12 |
| 2008/0116232 | A1 | 5/2008 | Michaux et al. | |
| 2012/0024899 | A1 * | 2/2012 | Michaux et al. | 222/153.13 |
| 2013/0200107 | A1 * | 8/2013 | Presche | 222/153.13 |

FOREIGN PATENT DOCUMENTS

| | | |
|---|---|---|
| FR | 2904294 A1 | 2/2008 |
| FR | 2908116 A1 | 5/2008 |

* cited by examiner

*Primary Examiner* — Kevin P Shaver
*Assistant Examiner* — Michael J Melaragno
(74) *Attorney, Agent, or Firm* — Sughrue Mion, PLLC

(57) ABSTRACT

A fluid dispenser head including a fluid dispenser member; a dispenser endpiece that is connected to a nozzle via a duct; a pusher that is manually and axially movable down and up so as to move the dispenser endpiece in such a manner as to dispense fluid; and a rotary control hoop for moving the pusher axially between a storage position and an actuatable position. The head further includes axial guide for guiding the pusher axially without turning about its own axis; and rotary cam that is turned by the control hoop, the pusher being in engagement with the cam so as to urge the pusher in axial movement, without any turning component.

19 Claims, 3 Drawing Sheets

HEAD FOR DISPENSING FLUID MATERIAL

CROSS REFERENCE TO RELATED APPLICATIONS

This application is a National Stage of International Application No. PCT/FR2010/052630 filed Dec. 7, 2010, claiming priority based on French Patent Application No. 09 58813, filed Dec. 9, 2009, the contents of all of which are incorporated herein by reference in their entirety.

The present invention relates to a fluid dispenser head for associating with, or for mounting on, a fluid reservoir. The term "dispenser head" refers herein to the entire unit for mounting on a reservoir in order to constitute a fluid dispenser. By actuating the head, the fluid is taken from the reservoir and dispensed through a dispenser orifice. Such dispenser heads are frequently used in the fields of perfumery, cosmetics, or even pharmacy.

In conventional manner, the dispenser head includes a fluid dispenser member, such as a pump or a valve. The dispenser member generally comprises a body that is mounted in stationary manner relative to the reservoir, and a valve rod that is axially movable down and up relative to the body. The dispenser head also includes a pusher that is mounted on the valve rod and that is axially movable down and up so as to drive the valve rod. In order to expel the fluid, the dispenser head also includes a dispenser orifice that is connected to the valve rod. Thus, by pressing on the pusher by means of one or more fingers, the valve rod is pushed into the body of the dispenser member, thereby dispensing the fluid from the reservoir, optionally in metered manner.

In such a conventional dispenser head, the only possible movement of the pusher is axial movement down and up, imparted by the user who presses by means of one or more fingers on a thrust surface formed by the pusher. Since the pusher is mounted directly on the valve rod, its movement drives the movement of the valve rod directly. In other words, the pusher and the valve rod are secured to each other and are moved together as a single piece, simultaneously.

In the prior art, dispenser heads are also known provided with pushers that are movable in turning about their movement axis in order to achieve a locking function for the pusher. Thus, the pusher can be turned between a locked position in which it cannot be moved axially, and an actuatable position that is unlocked and in which the user can press on the pusher and move it axially down and up, so as to dispense the fluid. However, the pusher always remains coupled directly to the valve rod, such that they are constrained to being axially moved together, simultaneously.

In the prior art, document FR-2 904 294 is also known that describes a fluid dispenser head comprising: a pump; a pusher that is provided with a dispenser orifice that is connected to the pump via a flexible hose; and actuator means making it possible to cause the pusher to move both in turning and axially between a low axial position and a high axial position. An internal cam system makes it possible to transform the turning movement of the pusher into an axial movement. In order to actuate the system, a rotary control hoop is provided that is turned manually by the user. The pusher is thus constrained to move both axially and in turning. Given that the dispenser orifice is secured to the pusher and that the pump is stationary, the axial movement of the pusher necessarily implies plastic deformation of the flexible hose that connects the orifice to the pump. In the prior-art dispenser head, the dispenser orifice thus moves axially with the pusher, not only when the head is actuated, but also when the pusher is caused to turn by means of the actuation means. It has been found in empirical manner that the flexible hose does not always deform as desired: it can happen that the flexible hose deforms in such a manner that it forms a kink, thereby preventing the fluid from flowing therethrough. Crucially, the flexible hose lacks flexibility, and an acceptable solution for mitigating the problem of flexibility is to make the flexible hose by over-molding. However, over-molding requires a special mold and increases the cost price of the dispenser head considerably.

Consequently, the present invention seeks to overcome the problems of the above-mentioned prior art by defining a dispenser head of design that is different, but that still includes a pusher that is movable by means of a rotary control hoop and a cam system.

To do this, the present invention proposes a fluid dispenser head for mounting on a fluid reservoir so as to constitute a dispenser, the head comprising:

- a fluid dispenser member, such as a pump, comprising a body that is mounted in stationary manner relative to the reservoir, and a valve rod that is axially movable down and up;
- a dispenser endpiece that is mounted to turn on the valve rod, the endpiece being connected to a nozzle via a duct;
- a pusher that is manually and axially movable down and up so as to move the dispenser endpiece and the valve rod, in such a manner as to dispense fluid; and
- a rotary control hoop that is actuated manually in turning, without any axial component, so as to move the pusher axially between a storage position and an actuatable position;

the dispenser head further comprising:

- axial guide means, without any turning component, for guiding the pusher axially without turning about its own axis; and
- rotary cam means, without any axial component, that are turned by the control hoop, the pusher being in engagement with the cam means so as to urge the pusher in axial movement, without any turning component.

Unlike in the above-mentioned prior-art document, the pusher of the dispenser head is not turned by the control hoop: it moves only axially, without any turning component. In other words, the pusher does not turn relative to the reservoir. The pusher can thus be oriented and indexed relative to the reservoir: this is particularly advantageous when the visible top of the pusher includes an inscription, such as a logo, that will then always be positioned correctly relative to the reservoir. The rotary control hoop does indeed drive the endpiece and the cam means, but not the pusher that is prevented from turning by the axial guide means. The dispenser head of the invention conserves an overall configuration that is substantially similar to the configuration in prior-art document FR-2 904 294, as a result of the rotary control hoop: however, the pusher remains static in turning and the cam means turn.

In a particular embodiment, the nozzle is constrained to turn with the control hoop, and advantageously also to move axially. Advantageously, the dispenser endpiece is turned by the nozzle that is itself turned by the control hoop. Preferably, the duct is flexible so as to enable the pusher to be moved manually and axially while fluid is being dispensed. Advantageously, the cam means are turned, advantageously by the duct. In a variant, the duct may be rigid, the cam means and the dispenser endpiece thus possibly being molded as a single piece.

In another aspect of the invention, the pusher includes at least one axial guide lug in engagement with the axial guide means, and at least one cam pin in engagement with the cam means. Advantageously, the pusher includes a skirt that is substantially cylindrical and that defines an inside wall and an outside wall, the guide lug being arranged on the outside wall, and the cam pin being arranged on the inside wall, or vice versa.

According to another characteristic of the invention, the axial guide means are formed by a guide sleeve that is engaged in stationary manner around the dispenser member. Advantageously, the guide sleeve includes a radial slot in which the nozzle moves while the control hoop is being actuated. Preferably, the pusher is in abutment against the guide sleeve in the storage position.

In an advantageous embodiment of the invention, the cam means are formed by a cam cylinder that is engaged around the dispenser endpiece and inside the pusher. Advantageously, the cam cylinder includes a drive slot in which the duct is engaged.

In summary, the control hoop turns about its own axis on the stationary guide sleeve that prevents the pusher from turning, but that guides it axially. In addition, the control hoop causes the nozzle to turn, which in turn causes the dispenser endpiece and the cam means to turn. The result of the relative movements of the component elements of the dispenser head is that the pusher moves only axially, with the nozzle secured to the rotary control hoop. The duct connecting the endpiece to the nozzle needs only moderate flexibility, given that the endpiece turns with the nozzle. The flexibility of the duct is used only while the fluid is being dispensed by manually pressing the pusher. The nozzle remains stationary relative to the hoop, while the endpiece is moved axially.

It should be observed that the dispenser head of the invention uses only a small number of parts, namely five parts, if the pump is not counted.

The invention is described more fully below with reference to the accompanying drawings, which show an embodiment of the invention by way of non-limiting example.

Figure 1:
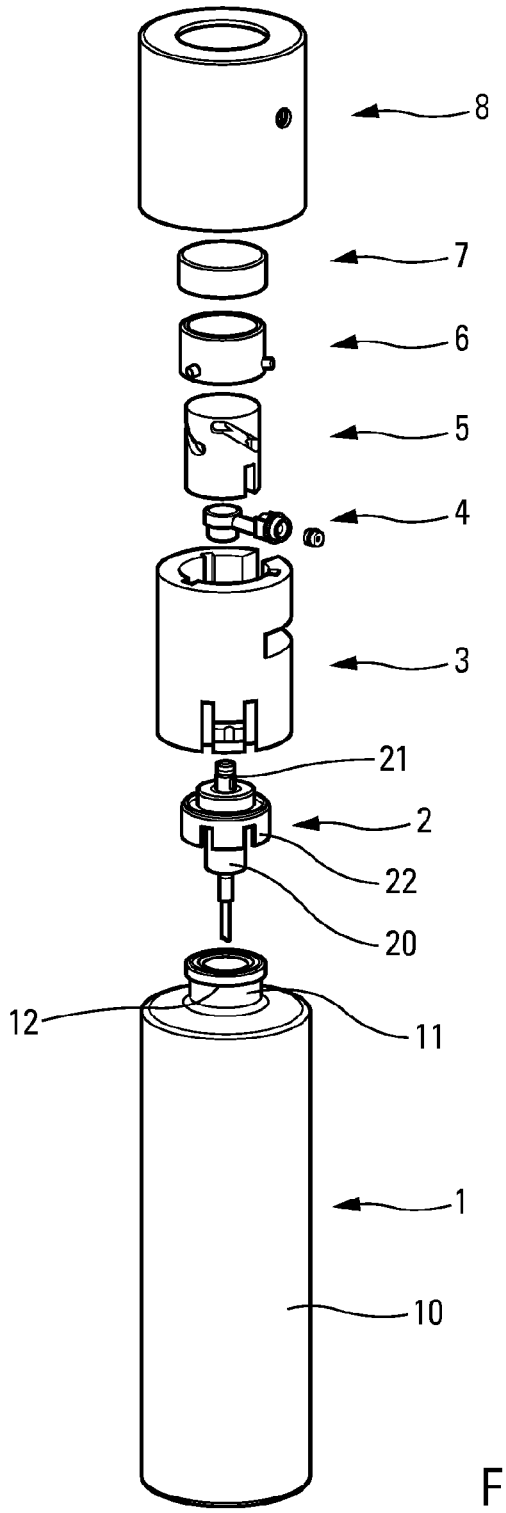
FIG. 1 is an exploded perspective view of a fluid dispenser in a non-limiting embodiment of the invention.

Reference is made firstly to FIG. 1 in order to explain in detail the structure of the various component elements of the dispenser head of the invention.

The dispenser head is for associating with a fluid reservoir 1 that defines a body 10 and a neck 11. The body 10 defines a working volume that is the volume of the reservoir. The neck 11 defines an opening that puts the inside of the body 10 into communication with the outside. Advantageously, the neck 11 forms a projecting outer peripheral rim that defines a shoulder 12 that is oriented downwards. The shoulder 12 serves to fasten the dispenser head on the reservoir. In this particular embodiment of the invention, the reservoir is circularly cylindrical, but other shapes could be envisaged.

In this particular embodiment, the dispenser head comprises six distinct component elements, namely a dispenser member 2, a guide sleeve 3, a dispenser endpiece 4, a cam cylinder 5, a pusher 6, 7, and a rotary control hoop 8. All the component elements may be made by injection-molding an appropriate plastics material. Certain component elements could also be made of metal, such as the rotary control member or the pusher, for example.

The dispenser member 2 may be a pump or a valve comprising a body 20 defining a bottom inlet that is optionally provided with a dip tube. The pump or valve also comprises a valve or actuator rod 21 that is axially movable down and up inside the body. In conventional manner, the valve rod 21 defines an internal flow duct for the fluid that is put into communication with the inside of the body 20 selectively by means of an outlet valve. The pump or valve could also be fitted with a fastener ring 22 that is provided with fastener tabs for coming into engagement below the shoulder 12 of the neck 11. In this embodiment, the fastener ring 22 is presented as a component element of the dispenser member. However, the fastener ring could also be in the form of an element that is distinct from the dispenser member, and that is fastened on the dispenser member. However, in this embodiment, the fastener ring is considered as forming an integral part of the dispenser member. This design is entirely conventional for a pump or a valve in the fields of perfumery, cosmetics, or even pharmacy. By pressing on the valve rod 21, the outlet valve (not shown) opens, and the fluid stored in the body 20 is then able to flow out through the rod 21.

Figure 4:
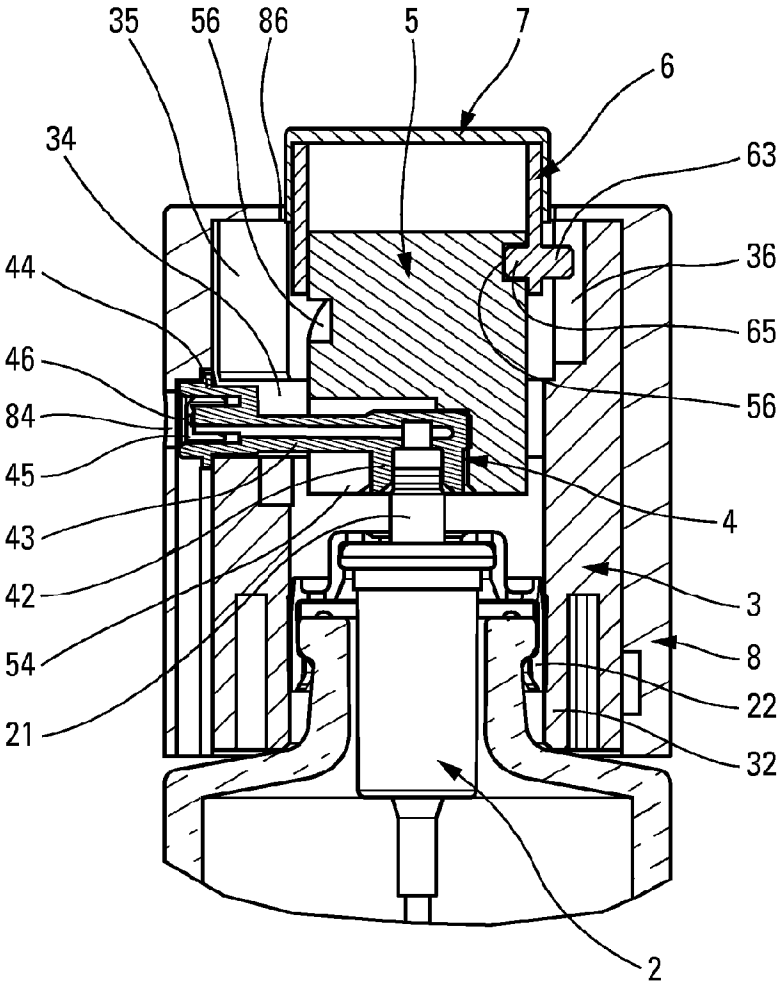
FIG. 4 is a vertical section view through the dispenser in FIGS. 1 and 2 in its working actuatable position.

The guide sleeve 3 is mounted on the dispenser member 2 in stationary manner, and preferably in permanent manner. Consequently, the guide sleeve 3 is stationary both axially and in turning relative to the reservoir 1. The guide sleeve 3 performs a plurality of distinct technical functions as described below, after the other component elements of the dispenser head have been described. Here, the structure of the guide sleeve 3 is described. The guide sleeve 3 may be made by injection-molding plastics material, like most of the other component elements of the dispenser head. The sleeve presents a general configuration that is substantially cylindrical and of circular section, such that it defines a hollow inside. The sleeve is open at both ends. In its bottom portion, the sleeve includes a double wall defining an annular gap. The inside wall 32 serves as a locking skirt for locking the fastener ring 22 that is engaged around the neck of the reservoir. As can be seen in FIGS. 3 and 4, the locking skirt 32 is engaged around the fastener ring 22, thereby preventing the skirt 22 from becoming disengaged from below the shoulder 12 formed by the neck 11. The outside wall that extends coaxially around the locking skirt 32 forms one or more flexible fastener tabs 38 for co-operating with the rotary control hoop 8, as described below. In its top portion, the guide sleeve 3 forms an axial vertical notch 35 that opens out to the top end of the sleeve. At its bottom end, the notch 35 is connected to a radial slot 34 that extends over a fraction of the periphery of the sleeve. By way of example, the slot 34 can extend over one fourth, or one third, of the periphery of the sleeve. Thus, the slot 34 communicates with the top end of the sleeve via the vertical notch 35. In addition, at its top portion, the inside wall of the guide sleeve 3 forms axial guide means 36, in particular in the form of vertical grooves formed in the inside wall of the sleeve, and opening out to the top end of the sleeve. The grooves can be seen, in part, in FIG. 2. The bottoms of the grooves are situated at approximately one fourth of the height of the sleeve down from the top.

Figure 2:
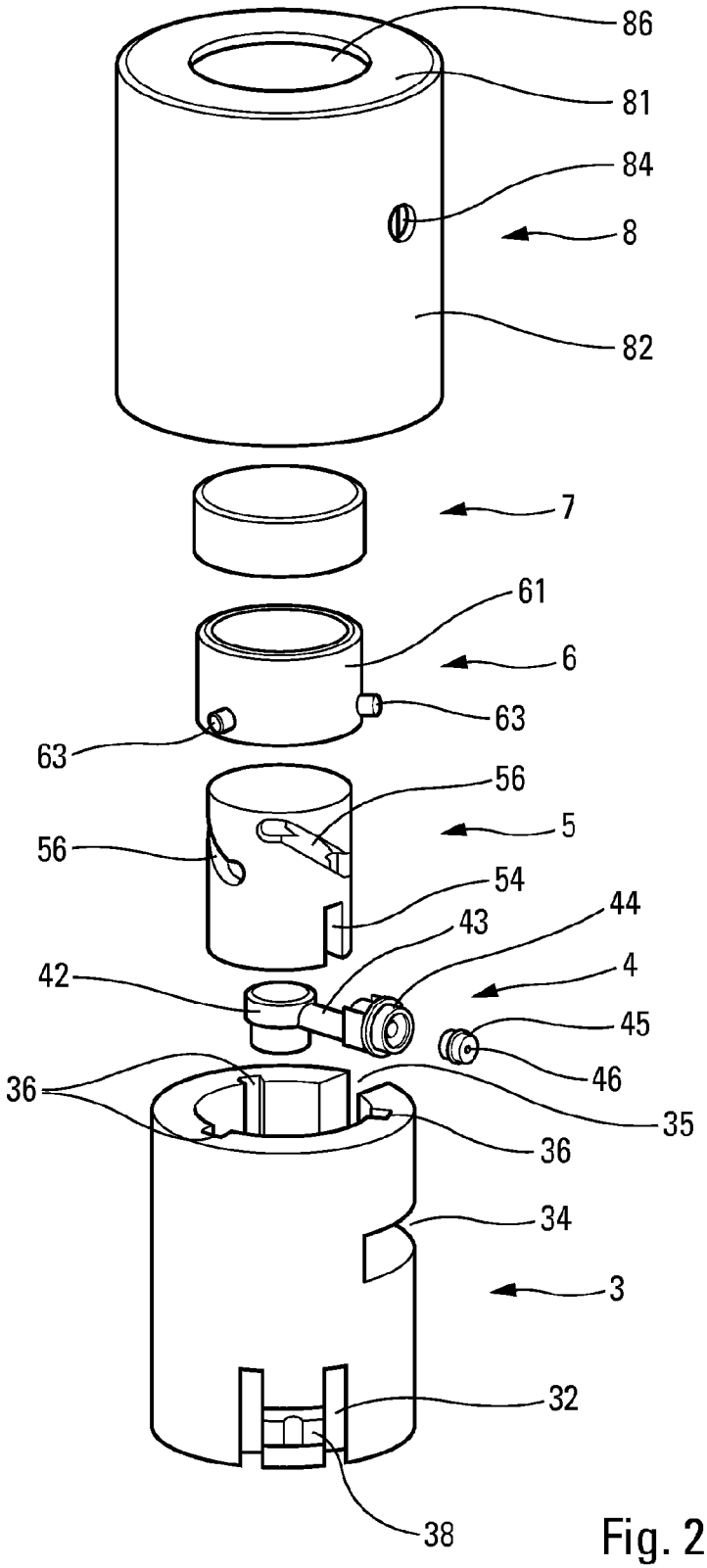
FIG. 2 is a larger-scale exploded perspective view of the FIG. 1 fluid dispenser head.
Figure 3:
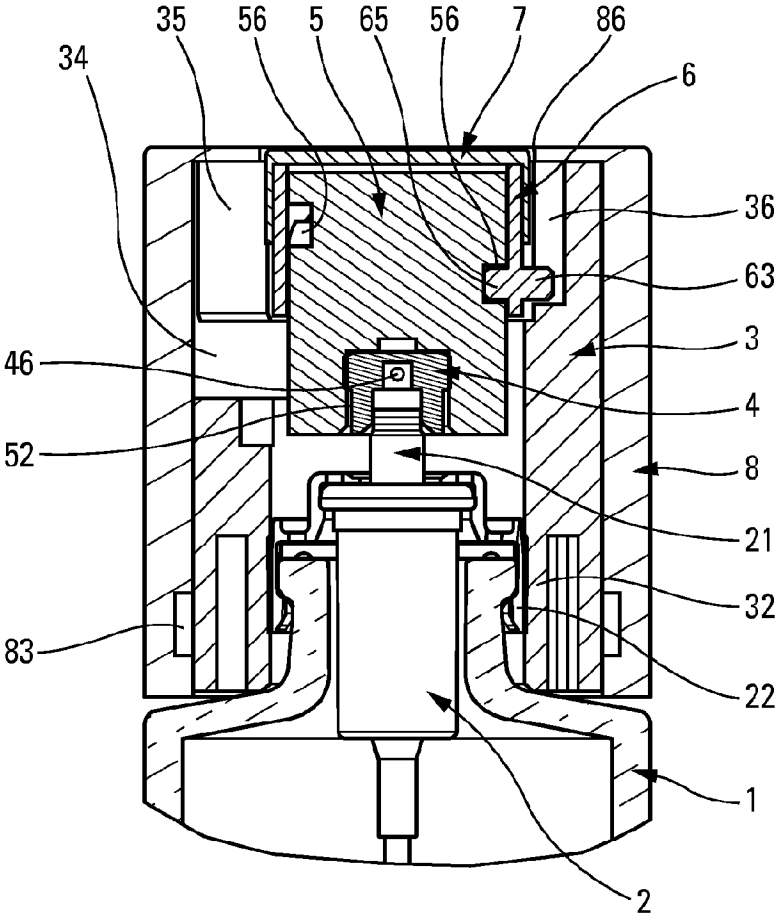
FIG. 3 is a vertical section view through the dispenser head in FIGS. 1 and 2 in its assembled state and in its non-working storage position.

The dispenser endpiece 4 may be made as a single piece, but preferably it is made as two pieces, as can be seen in FIG. 2. The dispenser endpiece 4 comprises firstly a cap 42 that is connected to a nozzle holder 44 via a duct 43 that advantageously presents a certain degree of flexibility. The endpiece 4 also comprises a nozzle 45 that is engaged in the nozzle holder 44, and that forms a dispenser orifice 46. The cap 42 is for mounting on the free end of the valve rod 21 of the dispenser member 2. Thus, the fluid coming from the rod 21 continues until it reaches the dispenser orifice 46, passing through the cap 42, the duct 43, and the nozzle 45. In the assembled state, as shown in FIGS. 3 and 4, the cap 42 covers the valve rod 21, and the duct 43 extends radially outwards. The nozzle holder 44 is engaged in the radial slot 34, and is movable along the length of the slot, as described below. In order to engage the nozzle holder 44 in the radial slot 34, it is inserted via the axial notch 35. In FIG. 4, it should also be observed that the nozzle holder 44 projects outwards, beyond the radial slot 34.

The cam cylinder is a substantially-cylindrical part that may be solid. Nevertheless, the cylinder is open at its bottom end so as to define a housing 52 for receiving the cap 42. On its outside wall, the cam cylinder defines one or more cam means 56 that are in the form of hollow cam paths that slope or are helical. By way of example, it is possible to provide three cam paths around the cam cylinder 5. It should also be observed that the cam cylinder 5 defines a drive slot 54 that is arranged vertically, and that opens out in the bottom end of the cylinder. The drive slot 54 is for receiving the duct 43 of the dispenser endpiece 4, as can be seen in FIG. 4. Thus, when the nozzle holder 44 is moved in the radial slot 34, the duct 43 causes the cam cylinder 5 to turn. In the assembled state, as shown in FIGS. 3 and 4, the cam cylinder 5 is engaged inside the guide sleeve 3, with the cap 42 engaged inside the housing 52 of the cylinder.

In this embodiment, the pusher is made up of two pieces, but alternatively, it could be made as a single piece. In the embodiment in the figures, the pusher comprises a pusher body 6 and a pusher cover 7. The body 6 may be made out of plastics material, while the cover 7 may be made out of metal. The pusher body 6 presents a configuration that is generally cylindrical, with a bottom end that is open, and a top end that may be open. The pusher body 6 thus defines a substantially-cylindrical skirt 61 having an outside wall and an inside wall. On the outside wall there are provided a plurality of guide lugs 63 that project radially outwards. The guide lugs are engaged to slide in axial guide grooves 36 of the guide sleeve 3, as can be seen in FIGS. 3 and 4. On the inside wall of the skirt 61 there are also provided cam pins 65 that project radially inwards. The pins 65 can be seen in FIGS. 3 and 4. It can be seen that the pins 65 are engaged in cam paths 56 that are formed in the cam cylinder 5. The cover 7 is merely in the form of a cup that is engaged around the skirt 61 of the pusher body 6. Thus, the pusher 6, 7 is in engagement with the guide sleeve 3 by means of the guide lugs 63 engaging in the guide grooves 36, and it also co-operates with the cam cylinder 5 by means of the cam pins 65 engaging in the cam paths 56. The pusher is thus constrained to move only axially inside the guide sleeve 3, the axial movement being generated by the movement of the cam pins 65 in the sloping cam paths 56.

With regard to the rotary control hoop 8, it defines a casing 82 that is substantially cylindrical and its top end is closed, in part, by a disk 81 that leaves an opening 86. In addition, the casing 82 includes a nozzle hole 84. The control hoop 8 is engaged around the guide sleeve 3, but it can be turned about the sleeve 3 through a certain angle that may be about 90°, for example. To do this, the hoop 8 may have one or more radial recesses 83 formed therein that co-operate by snap-fastening with the fastener tabs 38 of the sleeve 3. Thus, the control hoop 8 is free to turn, in limited manner, about the sleeve 3, but it cannot be removed from the sleeve 3 since it is held by means of the tabs 38 engaging in the recesses 83. With reference to FIGS. 3 and 4, it can be seen that the pusher 6, 7 extends through the opening 86 of the disk 81. It should also be observed that the nozzle holder 44 together with its nozzle 45 are engaged in the hole 84 and are secured thereto, so that the nozzle holder and its nozzle turn when the control hoop 8 is turned.

With reference more particularly to FIGS. 3 and 4, a complete operating cycle is described below in order to understand the interactions and the relative movements of the various component elements of the head. In FIG. 3, it can be seen that the top of the cover 7 is arranged in the same plane as the disk 81. Thus, the pusher is housed entirely inside the control hoop 8. In this position, it is not even possible to actuate the pusher, given that the guide lugs 63 are resting at the bottoms of the guide grooves 36. In a variant or in addition, the bottom edge of the pusher may come into abutment against a riser of the sleeve. The cam cylinder 5 is engaged fully inside the pusher 6, 7, with the cam pins 65 being arranged at the lowest points of the cam paths 56. Although not shown, the nozzle 45 is arranged at one end of the radial slot 34.

Starting from this non-working storage position, the user can hold the reservoir with one hand and turn the control hoop 8 with the other hand. It is also possible both to hold the reservoir and to turn the hoop with one hand. The turning movement of the hoop 8 generates the axial and/or turning movement of certain component elements of the head. More precisely, the nozzle and its nozzle holder are secured to the control hoop 8, since they are engaged in stationary manner inside the hole 84. The nozzle and its nozzle holder are thus caused to turn, thereby causing the duct 43 and the cap 42 to turn about, or on, the valve rod 21. In addition, given that the cam cylinder 5 is constrained to turn with the dispenser endpiece 4, as a result of the duct 43 being engaged in the axial slot 54, the cam cylinder 5 is also caused to turn. It should not be forgotten that the guide sleeve 3 is engaged in stationary manner on the dispenser member 2, i.e. it is prevented from moving axially or in turning relative thereto. In addition, the pusher is prevented from turning in the sleeve 3 as a result of the guide lugs 63 being engaged in the guide grooves 36. In contrast, the pusher is constrained to move axially under the effect of the cam cylinder 5 turning, given that the cam pins 65 are engaged in the sloping cam paths 56. The mutual interactions of the various component elements of the head have the final effect of moving the pusher only axially, without any turning component. This is clearly visible by comparing FIGS. 3 and 4 in which it should clearly be observed that, when in the working actuatable position in FIG. 4, the pusher projects out from the control hoop 8 in such a manner that it can be pressed manually by the user so as to dispense the fluid. The force exerted on the pusher by the user's finger is transmitted onto the actuator rod 21 by means of the cam cylinder 5, inside which there is housed the cap 42 that is engaged on the rod 21.

In order to better understand the moving behaviors of the various component elements of the dispenser head, the movement capacities of each of the elements are listed below:

- dispenser member 2: static in axial and turning movement relative to the reservoir;
- guide sleeve 3: static in axial and turning movement relative to the reservoir;
- dispenser endpiece 4: movable in turning without any axial component (except during actuation) relative to the reservoir;
- cam cylinder 5: movable in turning without any axial component (except during actuation) relative to the reservoir;
- pusher 6, 7: movable axially, but not in turning, relative to the reservoir 1; and
- rotary control hoop 8: movable in turning without any axial component relative to the reservoir.

In other words, the dispenser member 2 and the sleeve 3 are firmly secured to each other and are static relative to the reservoir; the endpiece 4 and the cylinder 5 are firmly secured to each other and are capable of turning relative to the reservoir without any axial component, except while the pusher is being actuated manually; the control hoop 8 and the nozzle 45 are capable of turning relative to the reservoir without any axial component; the pusher 6, 7 is capable of moving only axially, without any turning component.

Without going beyond the ambit of the invention, it is possible to envisage the following variants:

The reservoir, the guide sleeve, the pusher, and/or the control hoop may present a section other than circularly cylindrical. For example, when the skirt 61 of the pusher is not circular, it is possible to eliminate the guide lugs 63, given that the pusher is prevented from turning in the guide sleeve merely because of its shape. The pusher is thus easier to mold. The opening 86 in the hoop should present a shape and/or a size that does not cause the pusher to turn.

The duct 43 is not necessarily flexible. It may be rigid, but it is then necessary to provide a nozzle hole 84 of shape that is oblong, so that the nozzle and its nozzle holder can slide axially in the oblong hole while the pusher is being actuated manually. However, the nozzle and its nozzle holder are still constrained to turn with the hoop. In this configuration, it is even possible to mold the endpiece 4 integrally with the cam cylinder 5, with or without a separate nozzle fitted thereto. In this way, one component element is eliminated.

The guide sleeve 3 does not necessarily participate in fastening the dispenser member on the neck of the reservoir.

The dispenser endpiece 4 may be molded as two, or even three, separate pieces: the cap, the duct, and the nozzle holder.

By means of the dispenser head of the invention, it is possible to move the pusher between a low non-working storage position and a high working actuatable position without using the control hoop to turn it. In addition, the nozzle is completely stationary while fluid is being dispensed, since it is mounted on the hoop that is stationary while the pusher is being actuated manually by the user.

The invention claimed is:

1. A fluid dispenser head for mounting on a fluid reservoir so as to constitute a dispenser, the head comprising:

a fluid dispenser member, comprising a body that is mounted in stationary manner relative to the reservoir, and a valve rod that is axially movable down and up;

a dispenser endpiece that is mounted to turn on the valve rod, the endpiece being connected to a nozzle via a duct;

a pusher that is manually and axially movable down and up so as to move the dispenser endpiece and the valve rod, in such a manner as to dispense fluid; and a rotary control hoop that is actuated manually in turning, without any axial component, so as to move the pusher axially between a storage position and an actuatable position;

axial guide means, without any turning component, for guiding the pusher axially without turning about its own axis during the movement of the pusher between the storage position and the actuatable position; and rotary cam means, without any axial component, that are turned by the control hoop, the pusher being in engagement with the cam means so as to urge the pusher in axial movement, without any turning component.

2. A dispenser head according to claim 1, wherein the nozzle is constrained to turn with the control hoop.

3. A dispenser head according to claim 1, wherein the dispenser endpiece is turned by the nozzle that is itself turned by the control hoop.

4. A dispenser head according to claim 1, wherein the nozzle is constrained to turn with the control hoop and to move axially, the duct being flexible so as to enable the pusher to be moved manually and axially while fluid is being dispensed.

5. A dispenser head according to claim 1, wherein the duct is rigid, the cam means and the dispenser endpiece advantageously being molded as a single piece.

6. A dispenser head according to claim 4, wherein the cam means are turned, advantageously by the duct.

7. A dispenser head according to claim 1, wherein the pusher includes at least one axial guide lug in engagement with the axial guide means, and at least one cam pin in engagement with the cam means.

8. A dispenser head according to claim 7, wherein the pusher includes a skirt that is substantially cylindrical and that defines an inside wall and an outside wall, the guide lug being arranged on the outside wall, and the cam pin being arranged on the inside wall, or vice versa.

9. A dispenser head according to claim 1, wherein the axial guide means are formed by a guide sleeve that is engaged in stationary manner around the dispenser member.

10. A dispenser head according to claim 9, wherein the guide sleeve includes a radial slot in which the nozzle moves while the control hoop is being actuated.

11. A dispenser head according to claim 9, wherein the pusher is in abutment against the guide sleeve in the storage position.

12. A dispenser head according to claim 1, wherein the cam means are formed by a cam cylinder that is engaged around the dispenser endpiece and inside the pusher.

13. A dispenser head according to claim 12, wherein the cam cylinder includes a drive slot in which the duct is engaged.

14. The dispenser head according to claim 1, wherein dispenser member is a pump.

15. The dispenser head according to claim 1, wherein the duct is a rigid member.

16. The dispenser head according to claim 15, wherein the dispenser endpiece is directly mounted to the valve rod.

17. A fluid dispenser head for mounting on a fluid reservoir so as to constitute a dispenser, the head comprising:

a fluid dispenser member, comprising a body that is mounted in stationary manner relative to the reservoir, and a valve rod that is axially movable down and up;

a dispenser endpiece that is mounted to turn on the valve rod, the endpiece connected to a nozzle via a rigid duct;

a pusher that is manually and axially movable down and up so as to move the dispenser endpiece and the valve rod, in such a manner as to dispense fluid; and a rotary control hoop that is actuated manually in turning, without any axial component, so as to move the pusher axially between a storage position and an actuatable position;

an axial guide, without any turning component, that guides the pusher axially without turning about its own axis during the movement of the pusher between the storage position and the actuatable position; and a rotary cam, without any axial component, that is turned by the control hoop, the pusher in engagement with the rotary cam so as to urge the pusher in axial movement, without any turning component.

18. The dispenser head according to claim 17, wherein the axial guide is formed by a guide sleeve engaged in stationary manner around the dispenser member.

19. The dispenser head according to claim 18, wherein the guide sleeve includes a radial slot in which the nozzle moves while the control hoop is actuated.

* * * * *